US005440469A

United States Patent [19]

Gomes

[11] Patent Number: 5,440,469

[45] Date of Patent: Aug. 8, 1995

[54] LOW VOLTAGE TRACK LIGHTING FIXTURE

[76] Inventor: Roy Gomes, 136 Waverley Pl., New York, N.Y. 10011

[21] Appl. No.: 224,790

[22] Filed: Apr. 8, 1994

[51] Int. Cl.[6] ..... H01R 33/00

[52] U.S. Cl. ..... 362/226; 362/391; 362/404

[58] Field of Search ..... 362/226, 219, 221, 147, 362/404, 391

[56] References Cited

U.S. PATENT DOCUMENTS

| | | | |
|---|---|---|---|
| 5,025,357 | 6/1991 | Maurer | 362/391 |
| 5,128,847 | 7/1992 | Lin et al. | 362/226 |
| 5,158,360 | 10/1992 | Banke | 362/391 |

FOREIGN PATENT DOCUMENTS

| | | | |
|---|---|---|---|
| 8904437 | 11/1988 | European Pat. Off. | 362/404 |

*Primary Examiner*—Carroll B. Dority
*Attorney, Agent, or Firm*—Charles E. Temko

[57] ABSTRACT

A low voltage track lighting construction in which the transformer is mounted within a housing carried by an elongated track for adjustable movement therealong. A vertically oriented cylindrical member is relatively rotationally adjustable with respect to the housing and depends therefrom. The cylindrical member has a pair of oppositely disposed sockets. Engaging the cylindrical member are a pair of corresponding plugs, each plug supporting a vertically oriented rod section which may be effectively lengthened by engagement with additional sections. Slidably positioned on the rods are a second pair of plug elements, the inner ends of which engage corresponding parts of a lamp holding element to enable the lamp carrying element to be supported for pivotal movement about a horizontal axis. Additionally, the lamp holding element is capable of adjustment along a vertical axis and rotation about the same vertical axis.

4 Claims, 2 Drawing Sheets

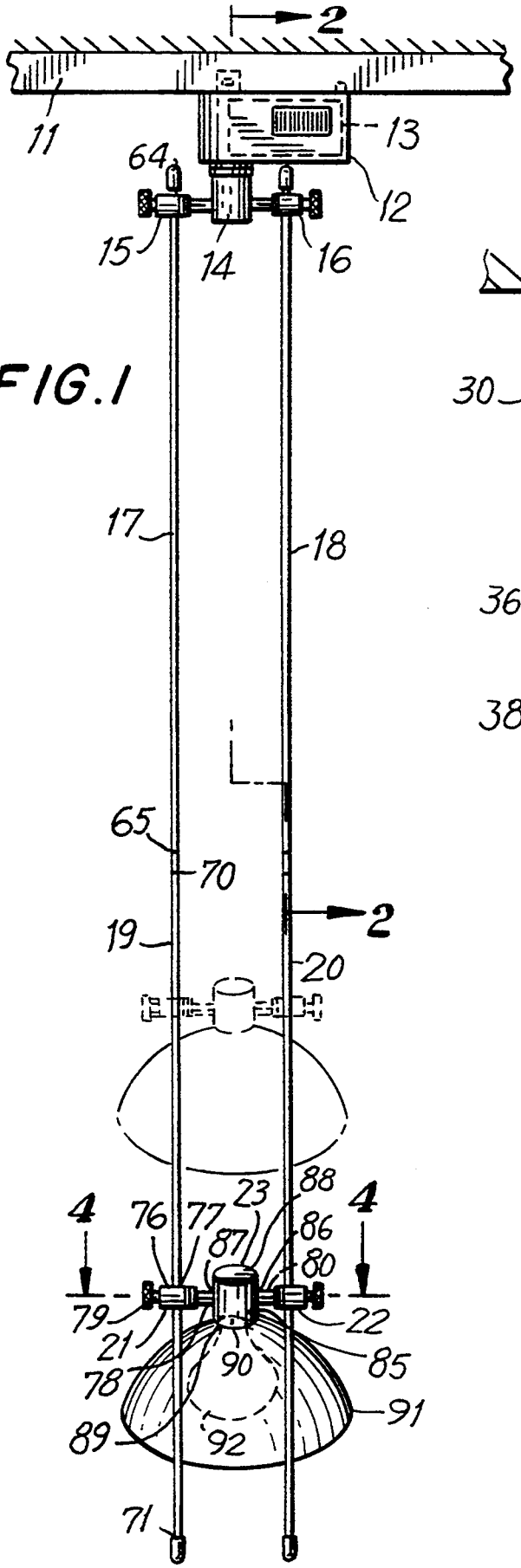
FIG. 1
FIG. 2
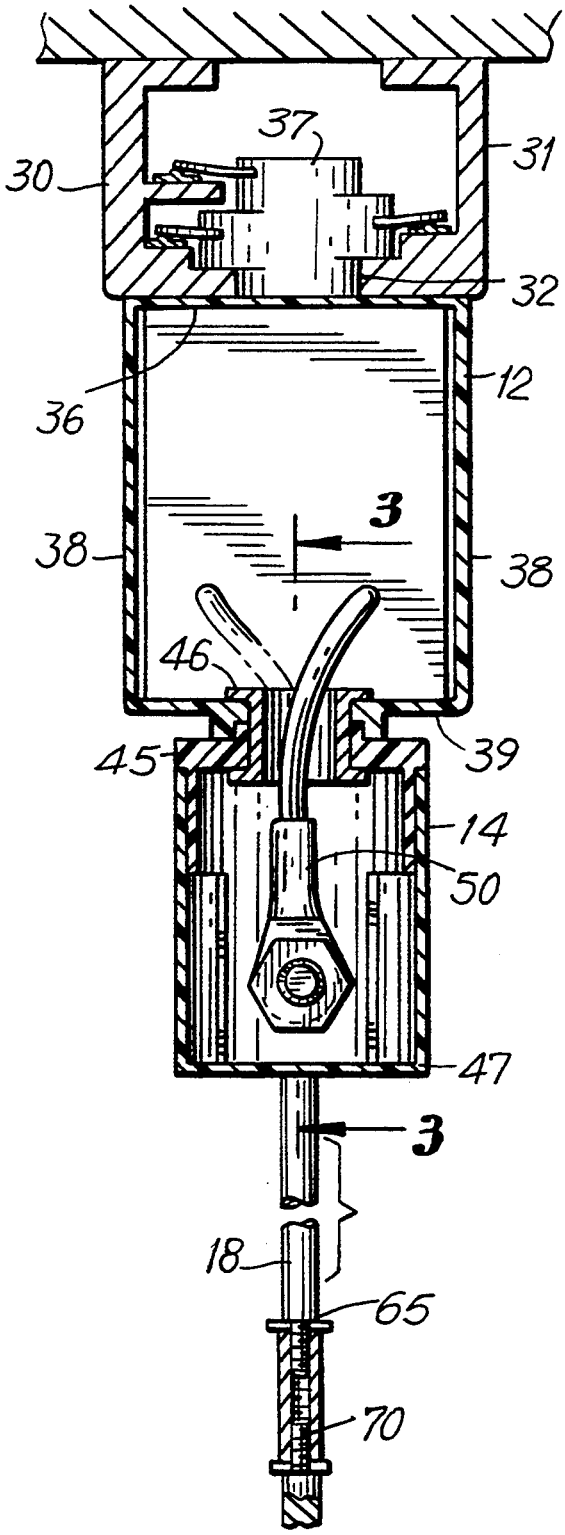

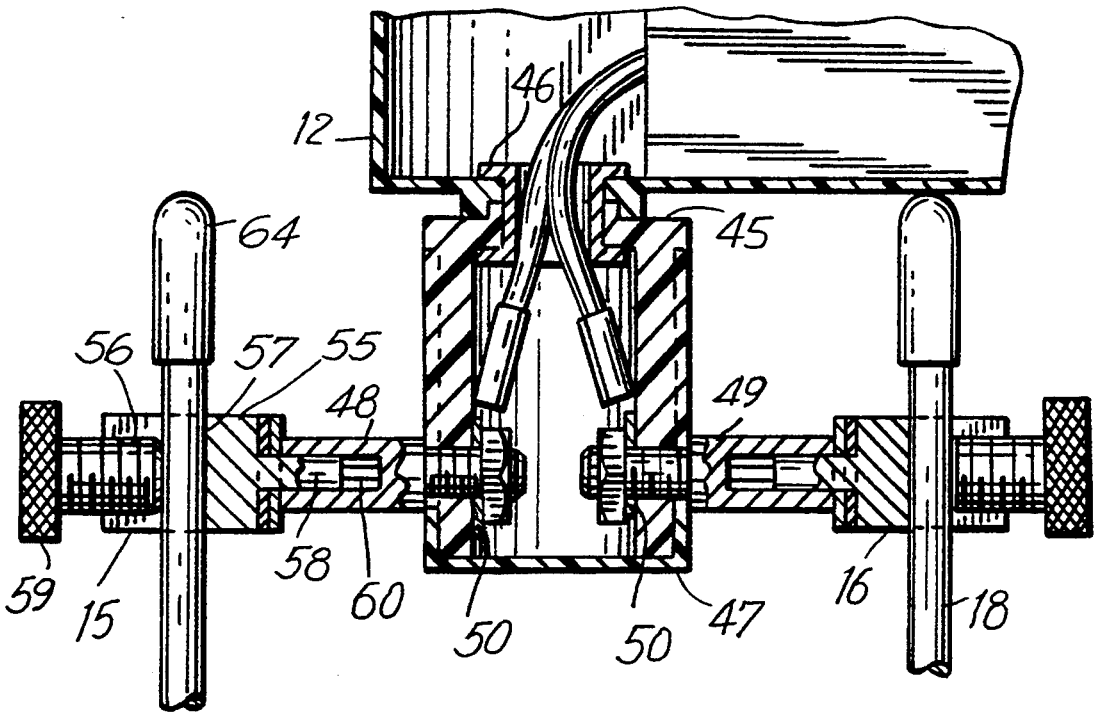
FIG. 3
FIG. 4
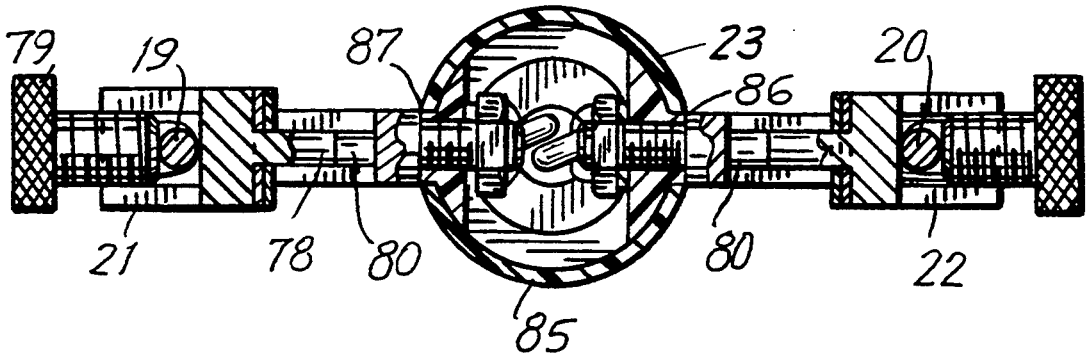

LOW VOLTAGE TRACK LIGHTING FIXTURE

BACKGROUND OF THE INVENTION

This invention relates generally to the field of lighting fixtures, and more particularly to an improved track lighting construction.

Typical prior art constructions feature an elongated track which is mounted upon the ceiling of a room, usually parallel to and spaced from an adjacent wall so as to enable spot lighting of a picture or other article mounted upon the wall. Lamp holding units are slidably positioned on the track and are capable of pivotal movement about horizontal and vertical axes. There is usually no provision for vertical adjustment, as a result of which the amount of light a particular picture or article receives varies with the vertical positioning of the article on the wall. This is particularly true in the case of lamps powered by normal 110 volt house current.

SUMMARY OF THE INVENTION

Briefly stated, the invention contemplates the provision of an improved track lighting construction of the class described in which the above-mentioned disadvantages have been substantially eliminated. To this end, the construction employs low voltage halogen type lamps which permit the use of metallic uninsulated lamp support members while offering complete safety to the user. A length of track slidably mounts a housing which encloses a low voltage transformer, the housing mounting a cylindrical member capable of rotational adjustment about a vertical axis. The cylindrical member includes a pair of electrically insulated horizontally oriented sockets. Engaging the sockets are a pair of electrically conductive plug elements. The plug elements each support a vertically oriented conductive rod. A second pair of plug elements are slidably mounted upon the rods. A lamp holder element is carried between the second pair of plug elements for adjustable rotation about a horizontal axis. Thus, the lamp holder element is capable of adjustment about vertical and horizontal axes as well as longitudinal movement along the vertical axis. Where the article to the illuminated is positioned at a relatively low level, the rods may be provided with threadedly engaged rod extensions to enable positioning of the lamp holder element immediately adjacent the article.

BRIEF DESCRIPTION OF THE DRAWINGS

In the drawings, to which reference will be made in the specification, similar reference characters have been employed to designate corresponding parts throughout the several views.

FIG. 1 is a side elevational view of an embodiment of the invention.

FIG. 2 is a fragmentary vertical central sectional view thereof.

FIG. 3 is a fragmentary vertical sectional view of a plug element forming part of the embodiment.

FIG. 4 is a similar horizontal sectional view of a second plug element forming a part of the embodiment.

DETAILED DESCRIPTION OF THE DISCLOSED EMBODIMENT

In accordance with the invention, the device, generally indicated by reference character 10, comprises broadly: a horizontal track element 11, a housing element 12 enclosing a low voltage transformer 13, a cylindrical support member 14, first and second plug elements 15 and 16, first and second rod members 17 and 18, first and second rod extension members 19 and 20, third and fourth plug elements 21 and 22, and a lamp holder element 23.

The track element 11 may be of generally conventional configuration, including first and second elongated members 30 and 31 defining an interstice 32 therebetween for engagement with the housing element 12.

The housing element 12 may be of metallic construction, but is preferably of molded synthetic resinous materials. It includes an upper wall 36 having track engaging means 37 of known type, a continuous side wall 38, and a lower wall 39. The transformer 13 is enclosed within the housing and is of conventional type including a 110 volt input and a 12 volt output.

The cylindrical support member 14 provides for rotational adjustment about a vertical axis. An upper end 45 includes rotational mounting means 46 of any desired type. Adjacent a lower end 47 are first and second oppositely disposed sockets 48 and 49 which include electrical terminals 50 which communicate with the 12 volt output of the transformer 13.

The plug elements 15 and 16 are substantially similar, each including an outer sleeve member 55 defining a longitudinal bore 56 and vertical openings 57. An electrically conductive plug 58 engages the terminal 50. A manual engageable knob 59 enables movement of the rods 17–18 within the sleeve member 55. Socket engaging means 60 may be frictional, threaded or lug type.

The rod members 17 and 18 are preferably in the form of solid tubes, each having an upper enlarged end 64 engaging the upper of the vertical openings 57. The lower ends 65 are provided with female threads. The rods may be of any desired length, although I have found a length of 14 inches to be suitable.

The rod extensions 19 and 20 are also in the form of solid tubes, each including an upper threaded end 70 and a lower threaded end 71. They are preferably also of 14 inch length, and may be engaged at the lower ends with additional extension members (not shown) if desired.

The third and fourth plug elements 21 and 22 resemble to a substantial degree the first and second plug elements 15–16, including an outer sleeve member 76, vertical openings 77, and a conductive plug 78, manually engageable knob 79 and socket engaging means 80. They are vertically adjustable over the entire length of the rod members, whereby the lamp holder element may be positioned at or near the horizontal level of an article to be illuminated.

The lamp holder element 23 may take any desired aesthetically pleasing configuration. In the illustrated form, it includes a vertically oriented cylindrical member 85 mounting first and second sockets 86 and 87. A lower end 89 mounts a lamp socket 88 and reflector 91 into which a known low voltage halogen lamp 92 is engaged.

It may be observed that the above described construction offers several significant advantages over the prior art. By supporting the lamp holder element upon a pair of vertically disposed electrically conductive rods, the lamp may be positioned immediately adjacent an article to be illuminated irrespective of the vertical position of the article between the floor and the ceiling of a room. This construction permits the use of relatively low voltage lamps with complete safety to the user, and facilitates the replacement of the lamp without difficulty. The rotational and revolving aspects of the construction allows the lighting of the object from substantially any angle or direction, rather than from overhead only, as is the usual case with track lighting. The simple interconnection by way of oppositely disposed plug elements permits easy and quick changing of the lamp holder, for decorative or styling purposes, and the easy changing of the lamps themselves from the standpoint of maintenance. The upper plug element offers rotation of the rods about a horizontal axis. They can be angled as much as 45 degrees from the vertical to increase the flexibility of the lighting, this feature being desirable where the track is a very substantial distance in a horizontal direction from the wall supporting the object to be illuminated. It will be appreciated that the structure is not limited to a single set of extension rods. In the case of rooms having very high ceilings, multiple sets of extension rods of desired length can be interconnected and positioned substantially in the same horizontal plane as the object to be illuminated. The use of oppositely disposed plug elements allows the replacement of the entire given lamp holder element with another of different appearance at any time desired, thereby enhancing the aesthetic appeal of the device.

I wish it to be understood that I do not consider the invention to be limited to the precise details of structure shown and described in the specification, for obvious modifications will occur to those skilled in the art to which the invention pertains.

I claim:

1. An improved track lighting fixture comprising: a horizontally oriented track element, a housing element slidably supported upon said track element, a vertically oriented cylindrical support element supported by and depending from said housing element and rotatable about a vertical axis, said support element having first and second horizontally opposed electrically conductive sockets; first and second horizontally oriented plug elements engaging said first and second sockets to electrically communicate therewith, said plug elements each defining a vertically oriented passage therein; first and second conductive rod elements each having upper ends fixedly positioned within one of said passages; first and second rod elements each having an upper end threadedly interconnected to a lower end of one of said first and second conductive rod elements; third and fourth plug elements arranged for sliding movement over said first, second, third and fourth rod elements; and a lamp holder element having third and fourth electrically conductive sockets engaged with said third and fourth plug elements; whereby said lamp holder element is capable of rotation about horizontal and vertical axes, and movement along said vertical axis.

2. An improved track lighting fixture in accordance with claim 1, further comprising a low voltage transformer supported within said housing element, said lamp holder including a low voltage incandescent lamp.

3. An improved track lighting fixture in accordance with claim 2, in which said rod elements are uninsulated.

4. An improved track lighting fixture comprising: a track element, a housing element slidably mounted upon said track element, a cylindrical member depending from said housing element and arranged for relative movement about a vertical axis relative thereto; first and second rod elements supported at upper ends thereof from said cylindrical member; third and fourth rod elements coaxially arranged and threadedly engaged with said first and second rod elements, respectively; and a lamp holder element arranged for slidable movement along said first, second, third and fourth rod elements, said lamp holder element having means for relative rotational movement about a horizontal axis.

* * * * *